US011285746B2

(12) United States Patent
Chan et al.

(10) Patent No.: US 11,285,746 B2
(45) Date of Patent: Mar. 29, 2022

(54) PRINTING WITH UAVS

(71) Applicant: KYOCERA Document Solutions Inc., Osaka (JP)

(72) Inventors: Sam Chinh Co Tang Chan, Garden Grove, CA (US); Duc Phu Truong, Westminster, CA (US)

(73) Assignee: KYOCERA Document Solutions Inc., Osaka (JP)

( * ) Notice: Subject to any disclaimer, the term of this patent is extended or adjusted under 35 U.S.C. 154(b) by 21 days.

(21) Appl. No.: 16/887,755

(22) Filed: May 29, 2020

(65) Prior Publication Data

US 2021/0370697 A1 Dec. 2, 2021

(51) Int. Cl.
*B41J 2/00* (2006.01)
*B41J 29/02* (2006.01)

(52) U.S. Cl.
CPC ..... *B41J 29/02* (2013.01)

(58) Field of Classification Search
None
See application file for complete search history.

(56) References Cited

U.S. PATENT DOCUMENTS

| | | | | |
|---|---|---|---|---|
| 10,112,715 | B2 * | 10/2018 | Whitmarsh | B64D 1/18 |
| 2016/0318607 | A1 * | 11/2016 | Desai | A01M 7/00 |
| 2017/0190104 | A1 | 7/2017 | Bostick | |
| 2017/0209885 | A1 * | 7/2017 | Neustadt | B05C 1/06 |
| 2017/0259920 | A1 * | 9/2017 | Lai | B64D 47/08 |

* cited by examiner

*Primary Examiner* — Erica S Lin
*Assistant Examiner* — Tracey M McMillion
(74) *Attorney, Agent, or Firm* — W. Webostad

(57) ABSTRACT

Systems and methods relate generally to aero-based printing. In an example thereof, obtained are unmanned aerial vehicles (UAVs) having a first UAV attached to a guide rail and a second UAV attached to an insert or a carriage guide ("guide"). The guide is configured for coupling into or onto the guide rail for slidable movement with a printhead assembly attached to the guide for movement therewith. The printhead assembly includes at least one colorant material holder. In-flight movement of the guide rail is controlled via the first UAV to a print target. In-flight movement of the second UAV is controlled for engagement of the guide into or onto the guide rail. The second UAV communicates to the printhead assembly for controlled printing responsive in part to movement of the guide by the second UAV relative to the guide rail.

20 Claims, 9 Drawing Sheets

PRINTING WITH UAVS

FIELD

The following description relates to printing. More particularly, the following description relates to unmanned aerial vehicles engaged to one another by a guide rail and a guide to provide a printer for printing.

BACKGROUND

Conventionally, cleaning and/or repainting a street sign without taking it down was difficult and dangerous.

SUMMARY

In accordance with one or more below described examples, a system relating generally to printing is disclosed. In such a system, there are a plurality of unmanned aerial vehicles (UAVs). A guide rail is attached to a first unmanned aerial vehicle (UAV) of the plurality of UAVs. An insert or a carriage guide ("guide") is attached to a second UAV of the plurality of the UAVs. The guide is configured for coupling into or onto the guide rail for slidable movement. A printhead assembly is attached to the guide for movement therewith. The printhead assembly includes at least one colorant material holder. The first UAV is controllable for in-flight movement of the guide rail to a print target. The second UAV is controllable for in-flight movement of the guide for engagement into or onto the guide rail. The second UAV is in communication with the printhead assembly for controlled printing including in part movement of the guide by the second UAV relative to the guide rail.

In accordance with one or more below described examples, another system relating generally to printing is disclosed. In such a system, there are a plurality of unmanned aerial vehicles (UAVs). A guide rail is attached to a first unmanned aerial vehicle (UAV) of the plurality of UAVs. An insert or a carriage guide ("guide") is attached to a second UAV of the plurality of the UAVs. The guide is configured for coupling into or onto the guide rail for slidable movement. A printhead assembly is attached to a slidable portion of the guide for movement with the slidable portion. The printhead assembly includes at least one colorant material holder. The first UAV is controllable for in-flight movement of the guide rail to a print target. The second UAV is controllable for in-flight movement of the guide for engagement into or onto the guide rail. The second UAV is in communication with the printhead assembly for controlled printing including in part movement of the slidable portion of the guide.

In accordance with one or more below described examples, a method relating generally to printing is disclosed. In such a method, obtained are a plurality of unmanned aerial vehicles (UAVs) having a first unmanned aerial vehicle (UAV) of the plurality of UAVs attached to a guide rail and a second UAV of the plurality of the UAVs attached to an insert or a carriage guide ("guide"). The guide is configured for coupling into or onto the guide rail for slidable movement with a printhead assembly attached to the guide for movement therewith. The printhead assembly includes at least one colorant material holder. In-flight movement of the guide rail is controlled via the first UAV to a print target. In-flight movement of the second UAV is controlled for engagement of the guide into or onto the guide rail. The second UAV communicates to the printhead assembly for controlled printing responsive in part to movement of the guide by the second UAV relative to the guide rail.

Other features will be recognized from consideration of the Detailed Description and Claims, which follow.

BRIEF DESCRIPTION OF THE DRAWINGS

Accompanying drawings show exemplary apparatus(es) and/or method(s). However, the accompanying drawings should not be taken to limit the scope of the claims, but are for explanation and understanding only.

FIG. 1-2 is a pictorial-perspective diagram depicting an example of an assembled aero-printing system prior to mating of a guide to a guide rail.

FIG. 1-3 is a pictorial-perspective diagram depicting an example of an assembled aero-printing system after mating of a guide to a guide rail.

FIG. 1-4 is a pictorial-block diagram depicting an example of an unmanned aerial vehicle ("UAV").

FIG. 2-1 through 2-3 are pictorial diagrams depicting respective examples of other types of guide-guide rail systems that may be used.

FIG. 3-1 is a pictorial-perspective diagram depicting an example of a framed, unassembled aero-printing system.

FIG. 3-2 is a pictorial-perspective diagram depicting an example of a framed, assembled aero-printing system after mating of a guide and a guide rail.

FIG. 3-3 is a pictorial-perspective diagram depicting an example of a framed, assembled aero-printing system after attachment of the mated guide and guide rail system of FIG. 3-2 to a print target.

FIG. 4 is a flow diagram depicting an example of an aero-printing flow.

DETAILED DESCRIPTION

Figure 1:
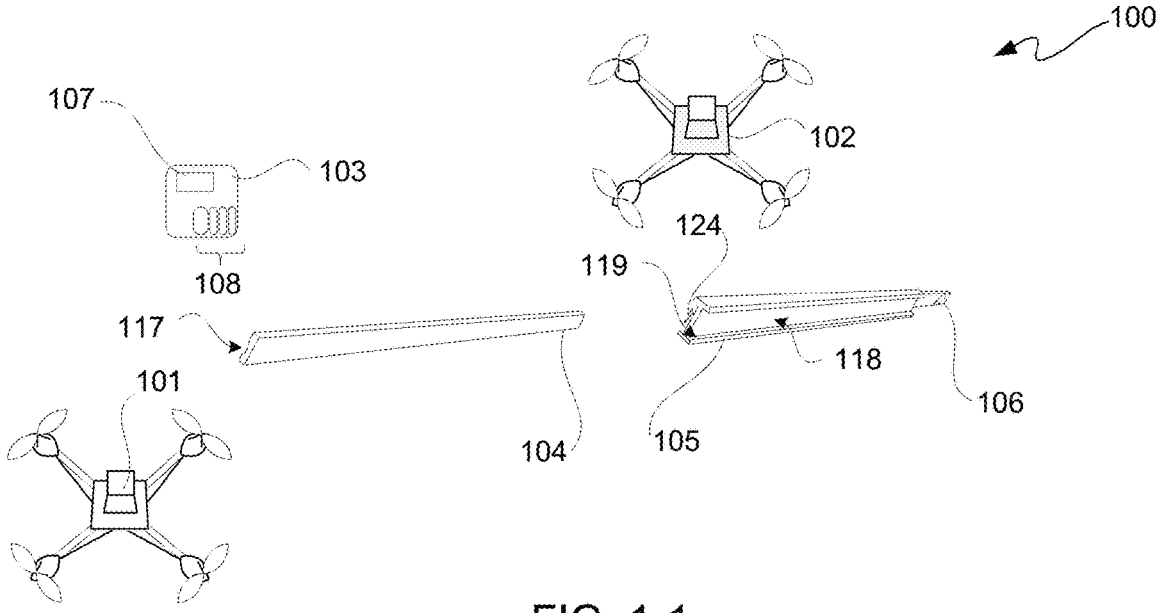
FIG. 1-1 is a pictorial-perspective diagram depicting an example of an unassembled aero-printing system.

In the following description, numerous specific details are set forth to provide a more thorough description of the specific examples described herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same number labels are used in different diagrams to refer to the same items; however, in alternative examples the items may be different.

Exemplary apparatus(es) and/or method(s) are described herein. It should be understood that the word "exemplary" is used herein to mean "serving as an example, instance, or illustration." Any example or feature described herein as "exemplary" is not necessarily to be construed as preferred or advantageous over other examples or features.

Before describing the examples illustratively depicted in the several figures, a general introduction is provided to further understanding.

A smart scalable printer may be provided by combining two or more UAVs to form an aero-printing device along a slidable linear rail. Such an aero-printing device may be used for example to clean and repaint a surface, such as street sign without taking it down and repainting. Additionally, such an aero-printing device may be used to apply one or more layers in place to coat a structure such as a bridge, transmission tower, or other structure, or to coat a bare wire or a bare portion of a wire.

As described herein, UAVs may be combined to form a linear rail printer. Such a rail printer may be configured to grip or attached to a street sign using electric-magnetic, suction, or two side wheels, or using pusher props. After printing one band, an aero-printing system may reposition itself sideways or vertically to start printing a next vertical or horizontal band, respectively. In a paper printing mode, where paper lays flat on a surface, and an aero printing system may fly to and land on top of such paper. A printhead may be moved horizontally to print one band, and then aero-printing system can be moved vertically to shift to a next band. If a paper's width exceeds a printhead's span for an in place aero-printing system, UAVs can move sideways to start printing another section.

An aero-printing system uses computer vision with AI to detect one or more print settings, such as for example where to start printing a next band. Using computer vision with AI helps keep images of one band aligned with its neighboring band or bands.

With the above general understanding borne in mind, various configurations for aero-printing systems and methods are generally described below.

Reference will now be made in detail to examples which are illustrated in the accompanying drawings. In the following detailed description, numerous specific details are set forth in order to provide a thorough understanding of the following described implementation examples. It should be apparent, however, to one skilled in the art, that the implementation examples described below may be practiced without all the specific details given below. Moreover, the example implementations are not intended to be exhaustive or to limit scope of this disclosure to the precise forms disclosed, and modifications and variations are possible in light of the following teachings or may be acquired from practicing one or more of the teachings hereof. The implementation examples were chosen and described in order to best explain principles and practical applications of the teachings hereof to enable others skilled in the art to utilize one or more of such teachings in various implementation examples and with various modifications as are suited to the particular use contemplated. In other instances, well-known methods, procedures, components, circuits, and/or networks have not been described in detail so as not to unnecessarily obscure the described implementation examples.

For purposes of explanation, specific nomenclature is set forth to provide a thorough understanding of the various concepts disclosed herein. However, the terminology used herein is for the purpose of describing particular examples only and is not intended to be limiting. As used herein, the singular forms "a", "an" and "the" are intended to include the plural forms as well, unless the context clearly indicates otherwise. As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context. It will also be understood that the term "and/or" as used herein refers to and encompasses any and all possible combinations of one or more of the associated listed items. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof. It will also be understood that, although the terms first, second, etc. may be used herein to describe various elements, these elements should not be limited by these terms, as these terms are only used to distinguish one element from another.

Some portions of the detailed descriptions that follow are presented in terms of algorithms and symbolic representations of operations on data bits, including within a register or a memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those involving physical manipulations of physical quantities. Usually, though not necessarily, these quantities take the form of optical, electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers or memories into other data similarly represented as physical quantities within the computer system memories or registers or other such information storage, transmission or display devices.

Concepts described herein may be embodied as apparatus, method, system, or computer program product. Accordingly, one or more of such implementation examples may take the form of an entirely hardware implementation example, an entirely software implementation example (including firmware, resident software, and micro-code, among others) or an implementation example combining software and hardware, and for clarity any and all of these implementation examples may generally be referred to herein as a "circuit," "module," "system," or other suitable terms. Furthermore, such implementation examples may be of the form of a computer program product on a computer-usable storage medium having computer-usable program code in the medium.

Any suitable computer usable or computer readable medium may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory ("RAM"), a read-only memory ("ROM"), an erasable programmable read-only memory ("EPROM" or Flash memory), an optical fiber, a portable compact disc read-only memory ("CD-ROM"), an optical storage device, a transmission media such as those supporting the Internet or an intranet, or a magnetic storage device. The computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to the Internet, wireline, optical fiber cable, radio frequency ("RF") or other means. For purposes of clarity by way of example and not limitation, the latter types of media are generally referred to as transitory signal bearing media, and the former types of media are generally referred to as non-transitory signal bearing media.

Computer program code for carrying out operations in accordance with concepts described herein may be written in an object-oriented programming language such as Java, Smalltalk, C++ or the like. However, the computer program code for carrying out such operations may be written in conventional procedural programming languages, such as the "C" programming language or similar programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through a local area network ("LAN") or a wide area network ("WAN"), or the connection may be made to an external computer (for example, through the Internet using an Internet Service Provider).

Systems and methods described herein may relate to an apparatus for performing the operations associated therewith. This apparatus may be specially constructed for the purposes identified, or it may include a general-purpose computer selectively activated or reconfigured by a computer program stored in the computer.

Notwithstanding, the algorithms and displays presented herein are not inherently related to any particular computer or other apparatus. Various general-purpose systems may be used with programs in accordance with the teachings herein, or it may prove convenient to construct a more specialized apparatus to perform the operations. In addition, even if the following description is with reference to a programming language, it should be appreciated that any of a variety of programming languages may be used to implement the teachings as described herein.

One or more examples are described below with reference to flowchart illustrations and/or block diagrams of methods, apparatus (including systems) and computer program products. It will be understood that each block of the flowchart illustrations and/or block diagrams, and combinations of blocks in the flowchart illustrations and/or block diagrams, may be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer program instructions may also be stored in a computer-readable memory that can direct a computer or other programmable data processing apparatus to function in a particular manner, such that the instructions stored in the computer-readable memory produce an article of manufacture including instruction means which implement the function/act specified in the flowchart and/or block diagram block or blocks. The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks.

The flowcharts and block diagrams in the Figures illustrate the architecture, functionality, and operation of possible implementations of apparatuses (including systems), methods and computer program products according to various implementation examples. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems which perform the specified functions or acts, or combinations of special purpose hardware and computer instructions.

It should be understood that although the flow charts provided herein show a specific order of operations, it is understood that the order of these operations may differ from what is depicted. Also, two or more operations may be performed concurrently or with partial concurrence. Such variation will depend on the software and hardware systems chosen and on designer choice. It is understood that all such variations are within the scope of the disclosure. Likewise, software and web implementations may be accomplished with standard programming techniques with rule-based logic and other logic to accomplish the various database searching operations, correlation operations, comparison operations and decision operations. It should also be understood that the word "component" as used herein is intended to encompass implementations using one or more lines of software code, and/or hardware implementations, and/or equipment for receiving manual inputs.

FIG. 1-1 is a pictorial-perspective diagram depicting an example of an unassembled aero-printing system 100. Aero-printing system 100 includes an unmanned aerial vehicle (UAV) 101, a UAV 102, a printhead assembly 103, a guide rail 105, and an insert or a carriage guide ("guide") 104.

In this example, guide rail 105 has an I-beam or I-beam-like structure, such as in a linear guide rail system. Guide rail 105 may include one or more temporary attachment devices 124, which devices are described below in additional detail.

As is known, a linear guide rail system may include at least on track 119. In other examples of linear guide rail systems, a guide rail 105 may include opposing tracks 119 on a side for guiding and retention of a guide 104. A bottom or lower side of guide 104 may be inserted into track 119, and top and bottom sides of guide 104 may be inserted into a channel 118 of guide rail 105. In this example, a profile of guide 104 defines a recess 117 for facing a sidewall surface of channel 118 when mated for linear slidable movement with guide rail 105.

Guide rail 105 in this example includes a mounting protrusion 106 for attachment of a UAV 102. However, in another example, such a mounting protrusion may be omitted in favor of attaching UAV 102 directly to an I-beam portion of guide rail 105.

Printhead assembly 103 may be for a known type of printhead. For example, an inkjet printhead assembly may be used. Printhead assembly 103 may include one or more colorant material holders 108 for holding liquid inks. In this example, each colorant material holder ("ink material holder") 108 is a cartridge. Even though four cartridges are illustratively depicted, fewer or more cartridges may be used in other examples. Furthermore, in a toner-based printer, such as for example having a laser-based or light-emitting diode-based ("LED-based") printhead, implementation, a colorant material holder 108 may be used to hold toner as a colorant. However, in this example, an inkjet printhead is used, though other types of printheads, such as toner-based, solid ink-based, or dye-sublimation-based, among other types of printheads, may be used in other implementations.

Printhead assembly 103 includes a printhead (or print head) 107. Again, in this example, printhead 107 is an inkjet printhead; however, another type of printhead may be used in another example, such as for example a laser printhead. For purposes of clarity by way of example and not limitation, it shall be assumed that printhead assembly 103 is a known inkjet printhead assembly.

Figures 1, 2:
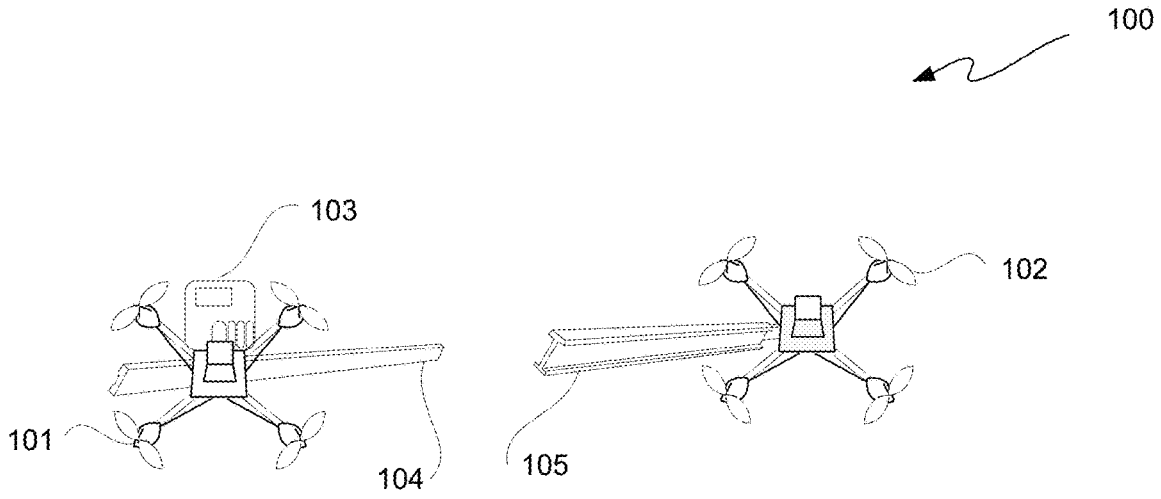

FIG. 1-2 is a pictorial-perspective diagram depicting an example of an assembled aero-printing system 100 prior to mating of guide rail 105 and guide 104. Guide rail 105 is attached to UAV 102 to provide a rigid structure for in-flight. Same or similarly, guide 104 is attached to UAV 101 to provide a rigid structure for in-flight. Because guide 104 is configured for coupling into or onto a guide rail 105 for slidable movement, UAV 101 may be attached to a distal end away from a mating end of guide 104 so as to avoid collision with UAV 102. However, in another example, UAV 102 may detach from guide rail 105 after positioning thereof, as described below in additional detail.

Printhead assembly 103 may be attached to guide 104 for movement therewith. Printhead assembly 103 may have printhead 107 positioned or offset from guide 104 so as not to be blocked by guide 104 or guide rail 105 for purpose of printing.

Figures 1, 2, 3:
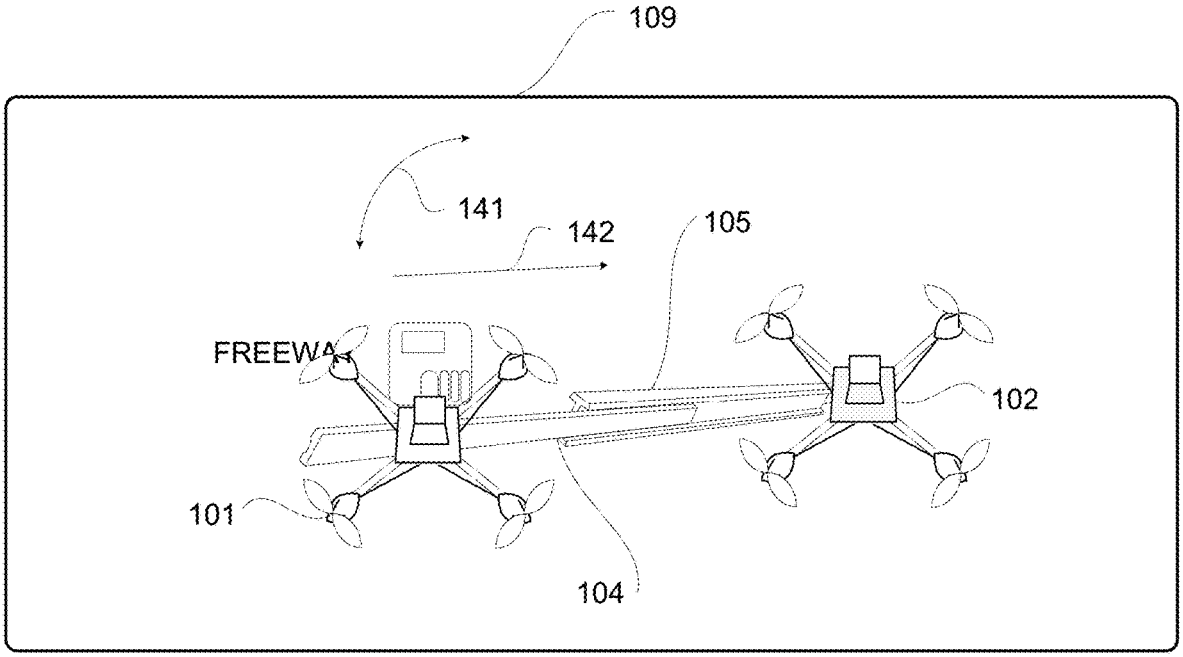

FIG. 1-3 is a pictorial-perspective diagram depicting an example of an assembled aero-printing system 100 after mating of guide rail 105 and guide 104 for slidable movement of guide 104 to guide rail 105. UAV 102 is controllable for in-flight movement of a guide rail 105 to a print target 109. In this example, a freeway overpass sign is used as a print target 109. However, other types of print targets may be used. For example, a sign may be another type of traffic sign, a billboard, or any other type of sign. Additionally, paper or other print medium may be used, such as for transferring a large image to such a medium. While printing as described herein generally described in terms of touching up or repairing a sign generally not readily accessible, such as a freeway overpass sign for example, the scope of applications of aero-printing system 100 is not limited to this particular example. Additionally, a print target 109, such as a rigid structure itself, or a rigid structure backing a print target 109, such as paper on a cement surface, may be temporarily coupled or removably attached to by aero-printing system 100.

Similarly, UAV 101 is controllable for in-flight movement of a guide 104 to a print target. Along those lines, UAVs 101 and 102 may be configured with GPS systems, as is known, for directing such UAVs generally to a print target 109. However, in another example, UAVs 101 and 102 may be controlled by an operator or pilot, as is known.

After getting in a vicinity of a print target 109, computer or machine vision of such UAVs 101 and 102 may be used for placement onto a target. UAV 102 is controllable for in-flight movement of guide rail 105 to a print target 109. This control may be provided using computer vision of UAV 102.

UAV 101 is controllable for in-flight movement of guide 104 for engagement into or onto guide rail 105. In this example, guide rail 105 is held against print target 109 by UAV 102 first, and then guide 104 is engaged or mated with guide rail 105 by movement of UAV 101. However, in another example, guide 104 may be engaged with guide rail 105 prior to placement of guide rail 105 to print target 109, and then both UAVs 101 and 102 may be directed for contact with print target 109, where UAV 101 may be offset from a surface of print target 109 through sufficiently proximate thereto for printing via printhead 107.

UAV 101 is in communication with printhead assembly for controlled printing responsive in part to movement of guide 104 by such UAV relative to guide rail 105, which may be held in place by operation of UAV 102. Even though a vertical orientation of print target 109 is assumed in this example, in another example a print target 109 may have a horizontal orientation or an orientation between a horizontal and a vertical orientation.

With slidable movement of guide 104 by moving UAV 101, offset printhead 107 may print along print target 109. UAVs 101 and 102 may be in communication with one another. Along those lines, an initial position of guide rail 105 may be for printing a portion of the word FREEWAY in this example, and then UAV 101 may communicate, such as by Bluetooth or other wireless communication, to UAV 102 to shift right in this example to print a remaining portion of the word FREEWAY in this example. Of course, other words or other types of images, as well as other directions, may be used in other examples.

Printhead assembly 103 may be moved by UAV 101 in a linear direction 142, with UAV 102 propellers pushing guide rail 105 to a surface of printer target 109. However, in another application, UAV 101 may move in an arcing or circular direction 141 to print an arcing or a circular band, and then UAV 101 may move in a lateral direction 142, such as to print in a lateral direction or to print another arcing or circular band. UAV 102 may use propellers to effect push pin an end of aero-printing system 100 to a surface of print target 109. In another example, a suction cup, a clamp, or other temporary attachment device 124, as described below in additional detail, with a gimbal mount or ball joint may be used to pin an end of aero-printing system 100 to a surface of print target 109 though allowing for arcing or rotational movement of an arm formed by guide rail 105 and guide 104 mated therewith.

FIG. 1-4 is a pictorial-block diagram depicting an example of a UAV 140. UAV may be either or both of UAVs 101 and 102. Commercially available UAVs or drones include proximity sensors, range detectors, multiple cameras with or without controllable gimbals, vision sensors, inertial measurement unit (IMU) modules (e.g., to report speed, angle, and acceleration, among other parameters), global navigation satellite sensor (GNSS) modules, target tracking systems with tracking multiple subjects simultaneously to choose a correct target, sphere panoramas (e.g., horizontal, vertical and 180 degree panoramas by stitching digital images together), and/or one or more computers.

Accordingly, a commercially available UAV may be programmed with an artificial intelligence (AI) or deep learning program, such as a known convolutional neural network (CNN), random forests, and/or support vector machine (SVM) programming for image recognition. Additionally, commercially available UAVs may transmit images and video back to an operator, such as via a remote control or a smart phone or tablet. This may be used for additional control, such as a more powerful computer and/or a human may perform image processing to confirm a print job is completed or completed satisfactorily. For purposes of clarity, a computer vision subsystem 132 configured for AI image recognition of UAV 140 is generally depicted.

In this example of a UAV 140, an available USB connection 134 may be used for communication with a printhead assembly 103, including providing power and control. Furthermore, a charging hub of UAV 140 may be extended with a wired platform 133 having contact pads 131, such as a plus and a minus contact pad for DC, for having another UAV with a mating system recharge UAV 140 in-flight or in place at a print target 109. UAV 140 and/or another type of UAV available may be used in accordance with the description herein.

FIG. 2-1 through 2-3 are pictorial diagrams depicting respective examples of other types of guide rail systems that may be used. FIG. 2-1 depicts a cylindrical linear guide rail 111 and carriage slide 112 that fits onto such guide rail. FIG. 2-2 depicts a rectangular-slotted linear guide rail 113 and a mating rectangular-protruded linear slide 114. FIG. 2-3 depicts a truck-channeled linear guide rail 115 and a truck slide insert guide 116 for insertion therein. Accordingly, these or any of many more types of guide rail system may be used in accordance an aero-printing system as described herein. Furthermore, a truck-channeled linear guide rail 115 may have gearing teeth for engagement with rotatable gears, where for example a truck slide insert guide 116 may have gears instead of one or more of wheels 129 and may include a stepper motor 128 powered for controllably rotating one or more of such gears by UAV 101.

FIG. 3-1 is a pictorial-perspective diagram depicting an example of a framed, unassembled aero-printing system 100. As much of the description of aero-printing systems 100 of FIGS. 1-1, 1-2 and 3-1 is the same, generally only the differences are described below for purposes of clarity and not limitation.

Guide 104 may include a backside channel 122 for having therein a linearly slidable sled 121. Printhead assembly 103 may be attached directly to linearly slidable sled 121 instead of directly to guide 104. In an example, linearly slidable sled may be a truck slide insert guide having a stepper motor, and such stepper motor may be directly controlled by printhead assembly 103 or a computer vision system of UAV 101 for movement of slidable sled 121 and thus movement of printhead 107.

A frame 125 may be attached to guide 104. In this example, frame 125 is a rectangle; however, other known polygons may be used in other examples. At each corner of frame 125, a suction cup, a magnet, a clamp, an electromagnet, or other temporary attachment device 124 may be attached. Attachment device 124 may be for temporary attachment or attachments for a print job, and then being able to remove each such attachment, namely removably attaching, for complete of each section of a print job or completion of a print job itself.

Frame 125 may have an opening or open area 126 for printhead 107 to print to a surface of a print target. Optionally, a portion 127 of frame 125 may be omitted in order to laterally expand open area 126. In this example, frame 125 is attached to guide 104 along a front facing or print target facing surface. However, in another example, frame 125 may be attached to guide 104 along a back facing or print target away facing surface.

Similarly, a frame 125 may be attached to guide rail 105. Frames 125 of guide 104 and guide rail 105 may be same or similarly configured. For purposes of clarity by way of example and not limitation, it shall be assumed that a portion 127 of each of frames 125 is not omitted.

FIG. 3-2 is a pictorial-perspective diagram depicting an example of a framed, assembled aero-printing system 100 after mating of guide rail 105 and guide 104. As much of the description of aero-printing systems 100 of FIGS. 1-1, 1-2, 1-3, 3-1 and 3-2 is the same, generally only the differences are described below for purposes of clarity and not limitation. Printhead assembly 103 is shown in phantom for purposes of clarity and not limitation.

For engagement, there may be some slidable movement of guide 104 to guide rail 105. However, in this example, a printhead assembly 103 moves with movement of slidable sled 121 by use of a stepper motor in contrast to movement of guide 104 by movement of UAV 101.

Along those lines, a wiring harness 123 may be coupled between a printhead controller 130 of UAV 101 and printhead assembly 103 for electrical communication for controlling and powering printhead assembly 103 and a stepper motor associated with slidable sled 121. Temporary attachment devices 124 with structural stability provided from frames 125 may be used to temporarily hold and secure aero-printing system 100 to a facing surface of a print target 109, such as a rigid structure or a rigid structure backing a print target.

Even though only two UAVs for an aero-printing system 100 are depicted, aero-printing system 100 may be replicated for scaling for larger or faster printing undertakings. Frames 125 in such a multiple pairs of UAVs aero-printing system may be indexed to one another to form a grid. Such a grid may be used to divide up a print job.

Though printing has been described, a printhead 107 may be used to apply a cleaner prior to or without printing ink to a surface of a print target 109. In other words, a print target 109 may be for cleaning up only, cleaning up and printing, or printing only. In a toner-based printer example, a colorant may include toner; however, in this example of an inkjet-based printer, liquid ink is used for a colorant.

FIG. 3-3 is a pictorial-perspective diagram depicting an example of a framed, assembled aero-printing system 100 after mating of guide rail 105 and guide 104 as in FIG. 3-2 and after attachment to a print target 109. As much of the description of aero-printing systems 100 of FIGS. 1-1 through 1-3 and 3-1 through 3-2 is the same, generally only the differences are described below for purposes of clarity and not limitation. Printhead assembly 103 is shown in phantom for purposes of clarity and not limitation.

In this example, a smaller print target 109 is depicted. For a smaller print target, an edge of a sign for example may be grabbed and/or clamped by a temporary attachment device 124. In this example, side wheels, namely two wheels attached to one another with a shaft, may be used to hook to a top and side edges of print target 109. However, this or another type of clamping or hooking device may be used for temporary attachment device 124 in other examples.

To recap, a smart scalable printer may be provided by combining two or more UAVs to form an aero-printing device along a slidable linear rail. Such an aero-printing device may be used for example to clean and repaint a surface, such as street sign without taking it down and repainting. Additionally, such an aero-printing device may be used to apply one or more layers in place to coat a structure such as a bridge, transmission tower, or other structure, or to coat a bare wire or a bare portion of a wire.

As described herein, UAVs may be combined to form a linear rail printer. Such a rail printer may be configured to grip or attached to a street sign using electric-magnetic, suction, surface clamp, two side wheels, or pusher props force. After printing one band, an aero-printing system may reposition itself sideways or vertically to start printing a next vertical or horizontal band, respectively. In a paper printing mode, where paper lays flat on a surface, and an aero printing system 100 may fly to and land on top of such paper. A printhead may be moved horizontally to print one band, and then aero-printing system 100 can be moved vertically to shift to a next band. If a paper's width exceeds a printhead's span for an in place aero-printing system 100, UAVs can move sideways to start printing another section.

As previously described, aero-printing system 100 uses computer vision with AI to detect one or more print settings, such as for example where to start printing a next band. Using computer vision with AI helps keep images of one band aligned with its neighboring band or bands.

As previously described, UAV 101 may be configured with a computer vision subsystem for controlling movement for printing with printhead assembly 103 responsive to digital images obtained by such computer vision subsystem. Likewise, UAV 102, or UAV 101, may be configured with a computer vision subsystem for controlling positioning of a guide rail, or a guide, responsive to digital images obtained by such computer vision subsystem.

Figures 1, 2, 3, 4:
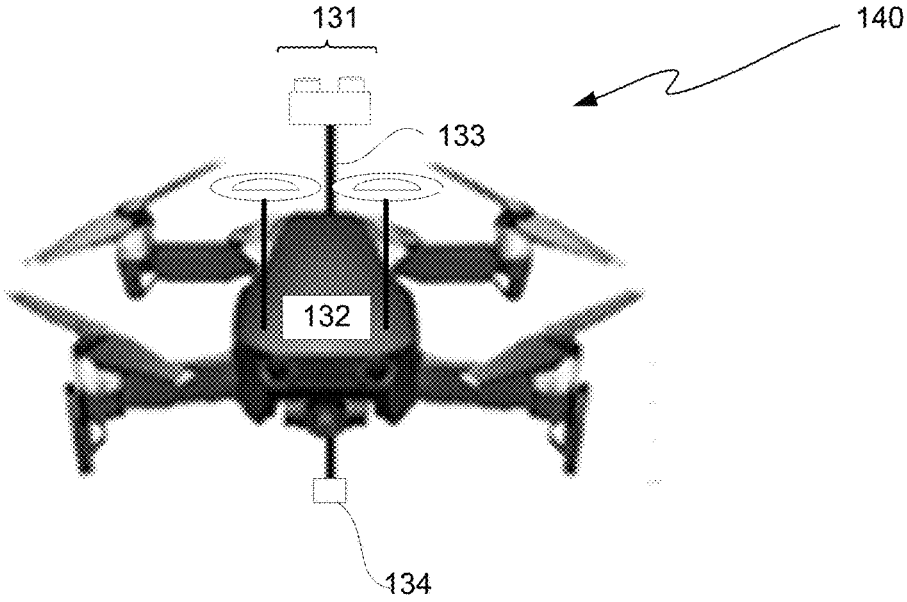
Figures 1, 2:
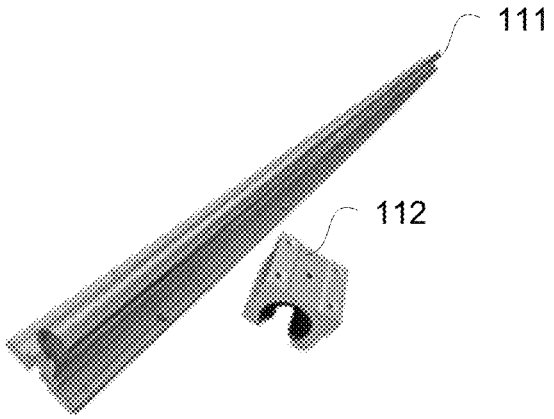
Figure 2:
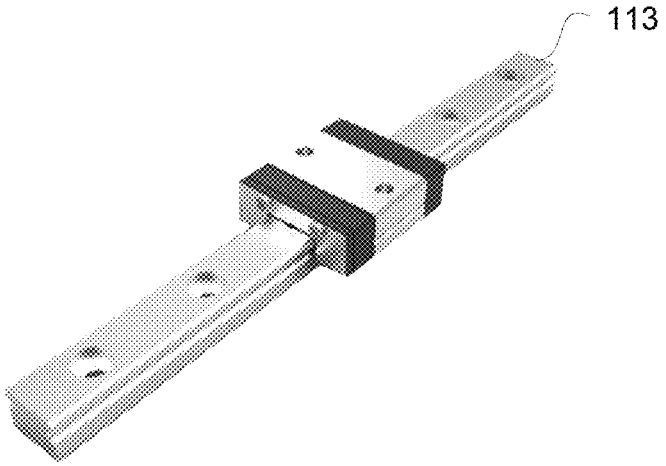
Figures 2, 3:
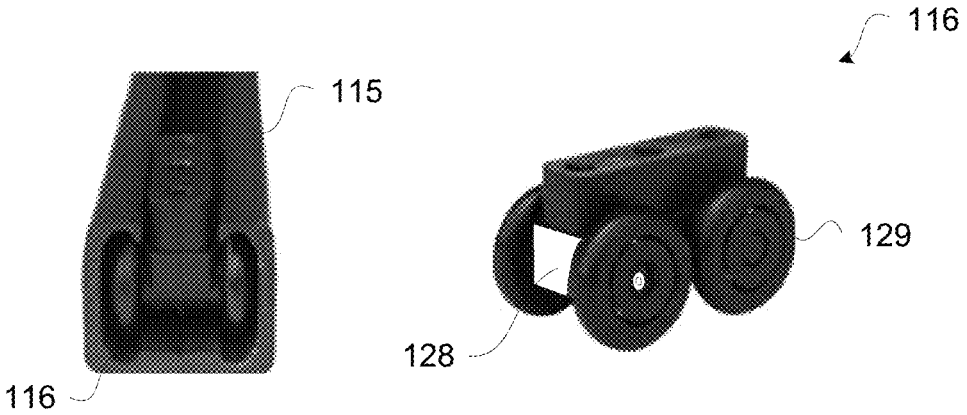
Figures 1, 3:
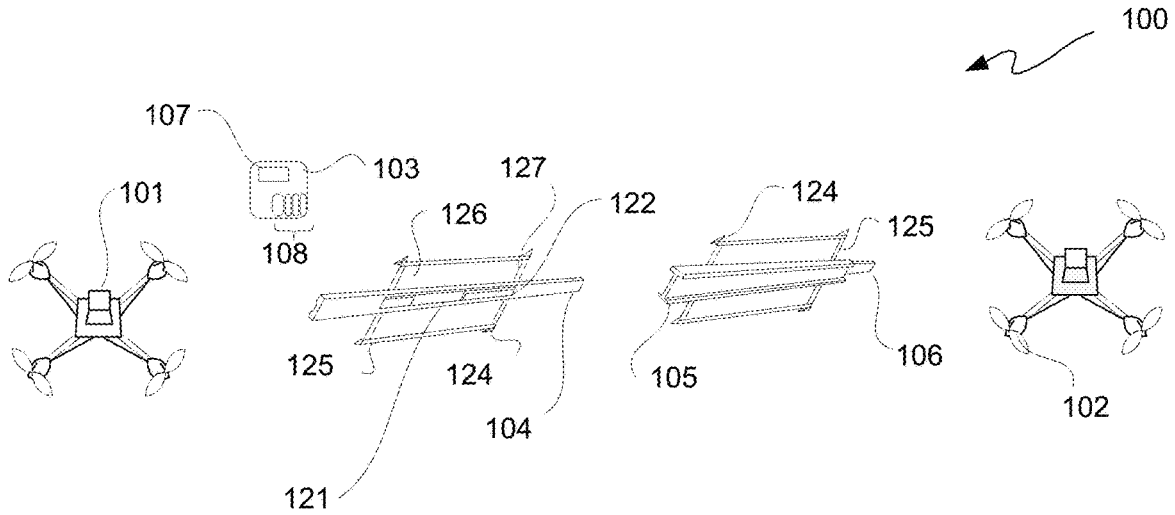
Figures 2, 3:
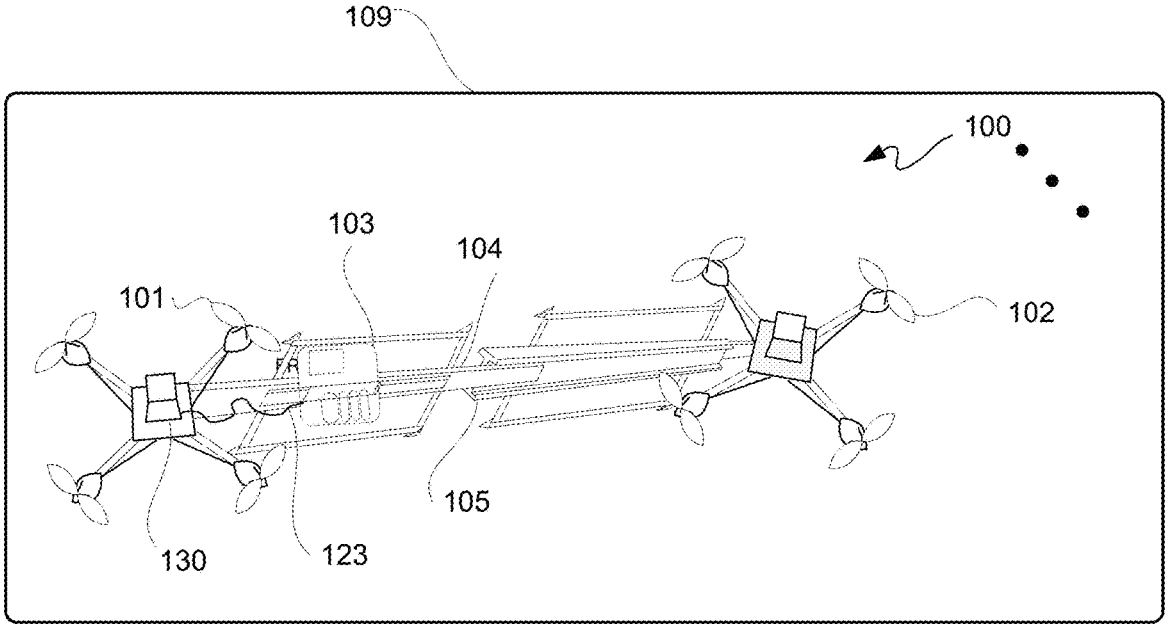
Figure 3:
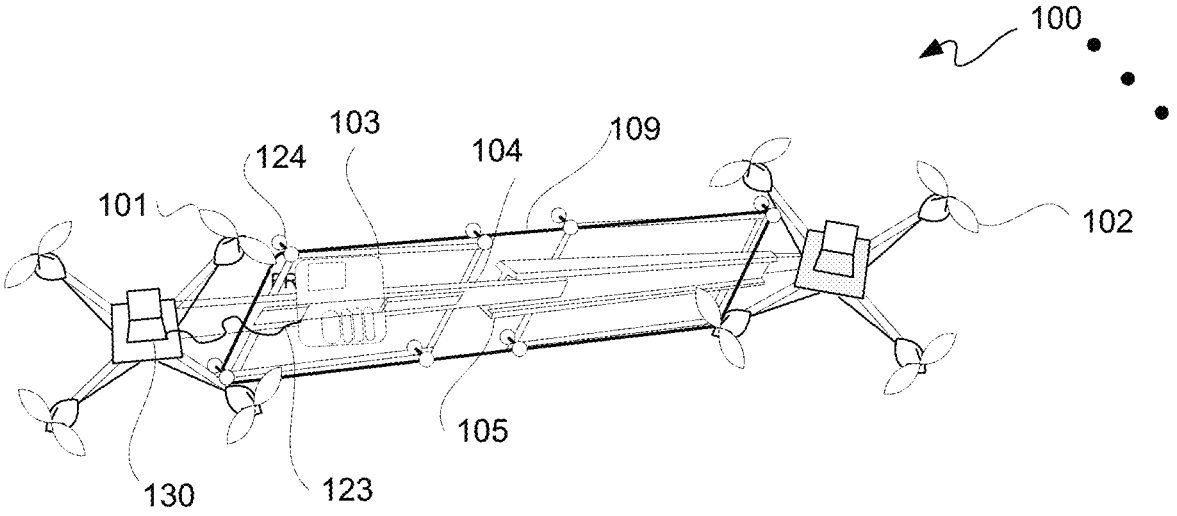
Figure 4:
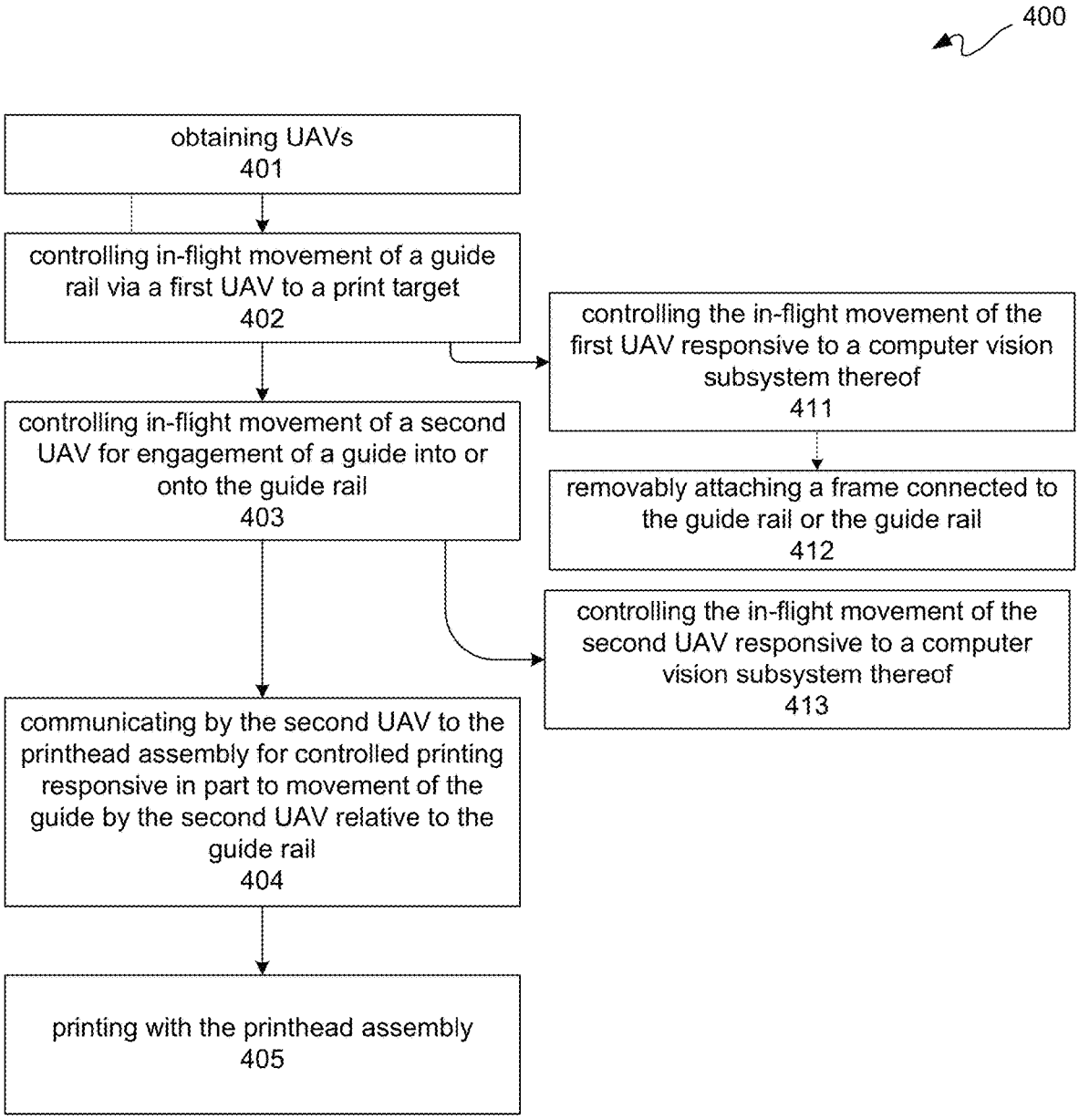

FIG. 4 is a flow diagram depicting an example of aero-printing flow 400. Aero-printing flow 400 is further described with simultaneous reference to FIGS. 1-1 through 4.

At operation 401, a plurality of UAVs having a first UAV 102 of such UAVs attached to a guide rail 105 and a second UAV 101 of such UAVs attached to an insert or a carriage guide ("guide") 104. At operation 402, in-flight movement of guide rail 105 is controlled via first UAV 102 to a print target 109.

Operation 402 may include operations 411 and 412. At operation 411, in-flight movement of first UAV 102 may be controlled a first computer vision subsystem thereof. At operation 412, a frame 125 connected to guide rail 105 or a guide rail 105 may be removably attached to a print target 109 or a rigid structure backing a print target 109, as previously described.

At operation 403, in-flight movement of second UAV 101 is controlled for engagement of guide 104 into or onto guide rail 105. Operation 403 may include operation 413. At operation 413, a second UAV 101 may have in-flight movement thereof controlled by a computer vision subsystem, thereof.

At operation 404, a second UAV 101 may communicate to printhead assembly 103 for controlled printing responsive in part to movement of guide 104 by second UAV 101 relative to guide rail 105. At operation 405, printing to a print target 109 may be performed using printhead assembly 103.

Because one or more of the examples described herein may be implemented in using a network, such as for a cloud-based SaaS implementation, or a computing system, as well as a mobile device and a printhead assembly, a detailed description of examples of each is provided. However, it should be understood that other configurations of one or more of these examples may benefit from the technology described herein.

Figure 5:
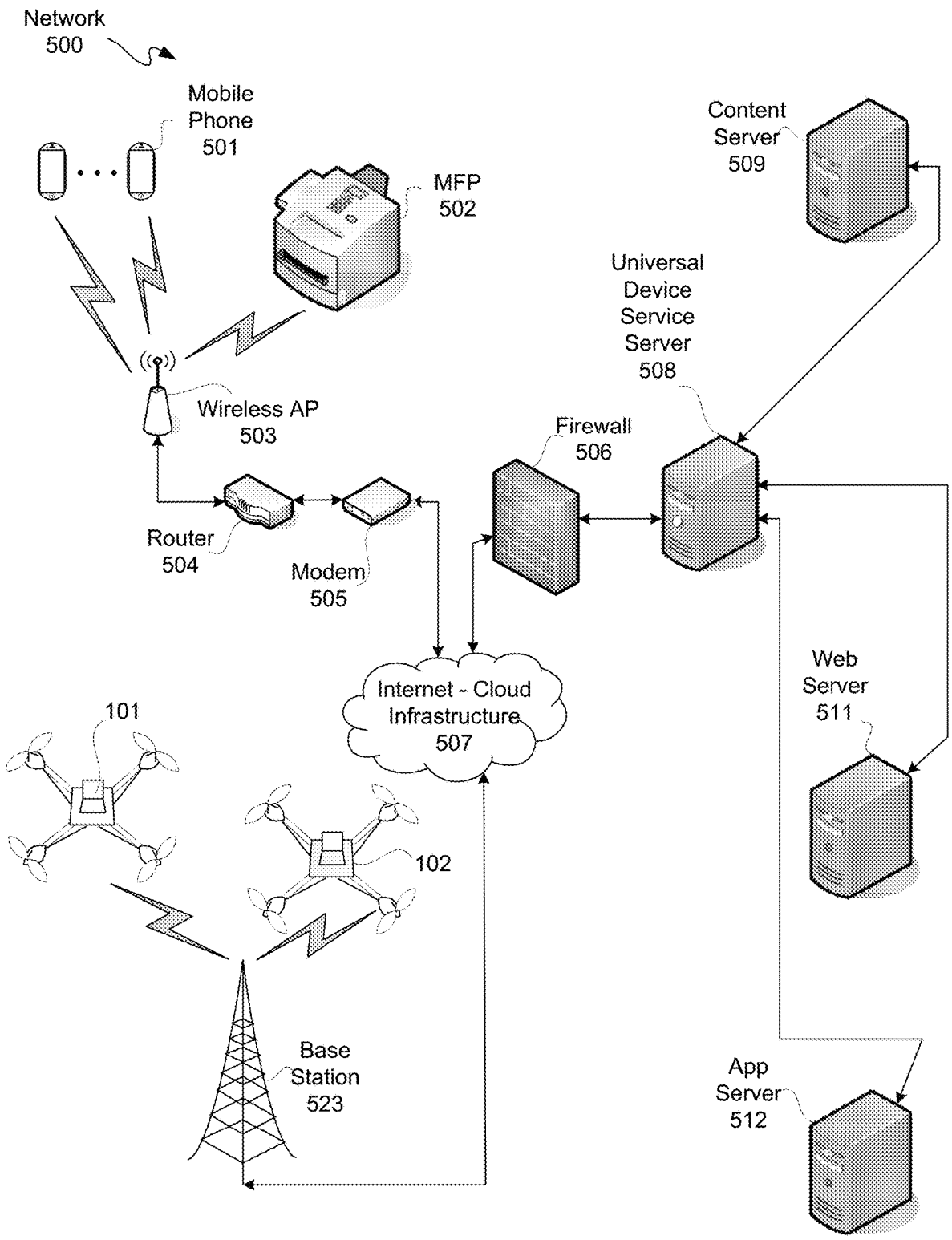
FIG. 5 is a pictorial diagram depicting an example of a network.

FIG. 5 is a pictorial diagram depicting an example of a network 500, which may be used to provide a SaaS platform for hosting a service or micro service for use by a user device, as described herein. Along those lines, network 500 may include one or more mobile phones 501 and/or other web-usable devices in wired and/or wireless communication with a wired and/or wireless access point ("AP") 503 connected to or of a wireless router. Furthermore, one or more of such web-usable wireless devices, such as UAVs 101 and 102, may be in wireless communication with a base station 523.

Wireless AP 513 may be connected for communication with a router 504, which in turn may be connected to a modem 505. Modem 505 and base station 523 may be in communication with an Internet-Cloud infrastructure 507, which may include public and/or private networks.

A firewall 506 may be in communication with such an Internet-Cloud infrastructure 507. Firewall 506 may be in communication with a universal device service server 508. Universal device service server 508 may be in communication with a content server 509, a web server 511, and/or an app server 512. App server 512, as well as a network 500, may be used for downloading an app or one or more components thereof for accessing and using a service or a micro service as described herein. Along those lines, an aero-printing system as described herein can be ordered for printing. A city may have workers to identify signs needing fixing, and order up an aero-printing system as described herein to fix such signs.

Figure 6:
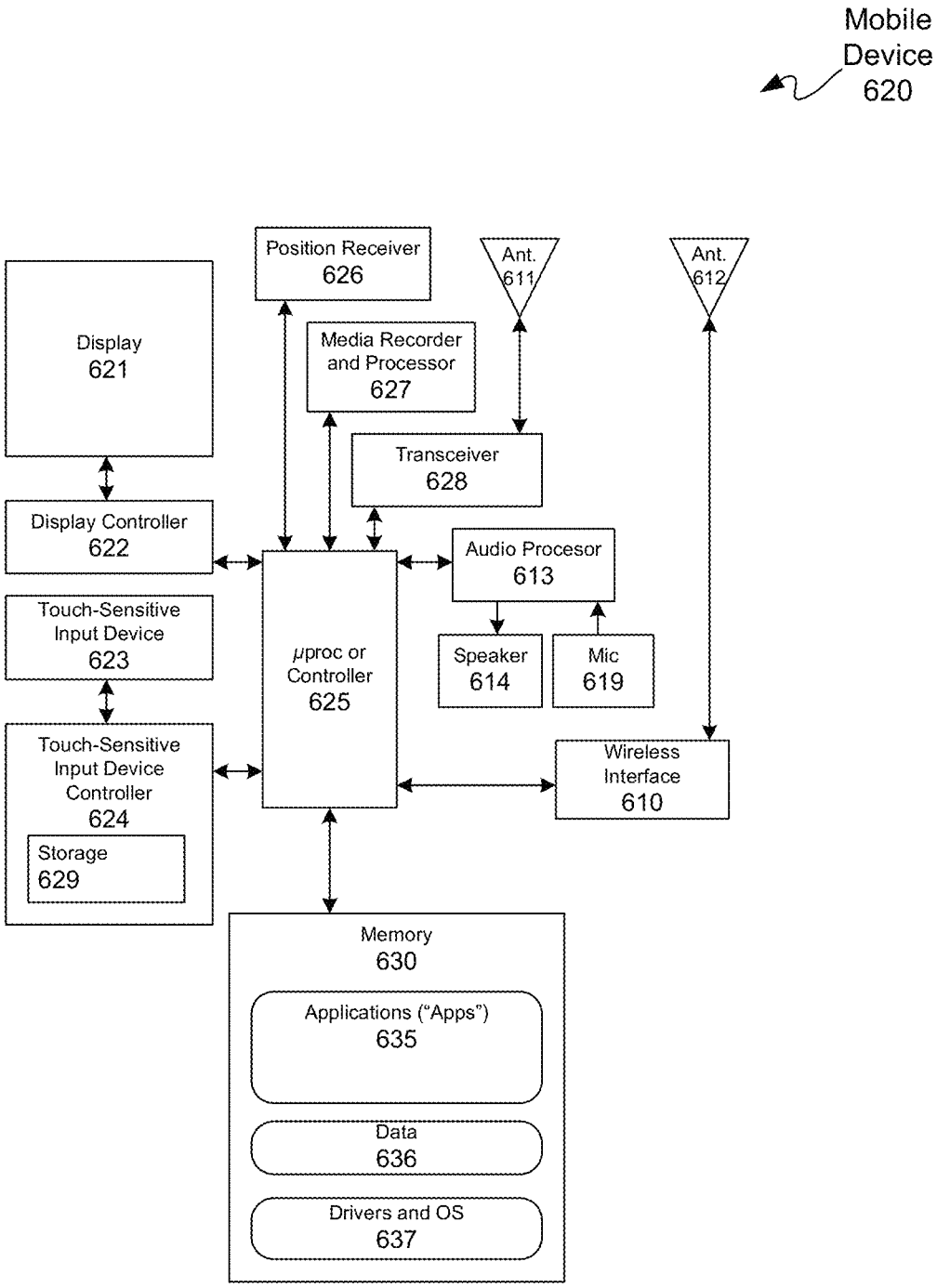
FIG. 6 is block diagram depicting an example of a portable communication device.

FIG. 6 is block diagram depicting an example of a portable communication device ("mobile device") 620. Mobile device 620 may be an example of a mobile device, as previously described.

Mobile device 620 may include a wireless interface 610, an antenna 611, an antenna 612, an audio processor 613, a speaker 614, and a microphone ("mic") 619, a display 621, a display controller 622, a touch-sensitive input device 623, a touch-sensitive input device controller 624, a microprocessor or microcontroller 625, a position receiver 626, a media recorder 627, a cell transceiver 628, and a memory or memories ("memory") 630.

Microprocessor or microcontroller 625 may be programmed to control overall operation of mobile device 620. Microprocessor or microcontroller 625 may include a commercially available or custom microprocessor or microcontroller.

Memory 630 may be interconnected for communication with microprocessor or microcontroller 625 for storing programs and data used by mobile device 620. Memory 630 generally represents an overall hierarchy of memory devices containing software and data used to implement functions of mobile device 620. Data and programs or apps as described hereinabove may be stored in memory 630.

Memory 630 may include, for example, RAM or other volatile solid-state memory, flash or other non-volatile solid-state memory, a magnetic storage medium such as a hard disk drive, a removable storage media, or other suitable storage means. In addition to handling voice communications, mobile device 620 may be configured to transmit, receive and process data, such as Web data communicated to and from a Web server, text messages (also known as short message service or SMS), electronic mail messages, multimedia messages (also known as MMS), image files, video files, audio files, ring tones, streaming audio, streaming video, data feeds (e.g., podcasts), and so forth.

In this example, memory 630 stores drivers, such as I/O device drivers, and operating system programs ("OS") 637. Memory 630 stores application programs ("apps") 635 and data 636. Data may include application program data.

I/O device drivers may include software routines accessed through microprocessor or microcontroller 625 or by an OS stored in memory 630. Apps, to communicate with devices such as the touch-sensitive input device 623 and keys and other user interface objects adaptively displayed on a display 621, may use one or more of such drivers.

Mobile device 620, such as a mobile or cell phone, includes a display 621. Display 621 may be operatively coupled to and controlled by a display controller 622, which may be a suitable microcontroller or microprocessor programmed with a driver for operating display 621.

Touch-sensitive input device 623 may be operatively coupled to and controlled by a touch-sensitive input device controller 624, which may be a suitable microcontroller or microprocessor. Along those lines, touching activity input via touch-sensitive input device 623 may be communicated to touch-sensitive input device controller 624. Touch-sensitive input device controller 624 may optionally include local storage 629.

Touch-sensitive input device controller 624 may be programmed with a driver or application program interface ("API") for apps 635. An app may be associated with a service, as previously described herein, for use of a SaaS. One or more aspects of above-described apps may operate in a foreground or background mode.

Microprocessor or microcontroller 625 may be programmed to interface directly touch-sensitive input device 623 or through touch-sensitive input device controller 624. Microprocessor or microcontroller 625 may be programmed or otherwise configured to interface with one or more other interface device(s) of mobile device 620. Microprocessor or microcontroller 625 may be interconnected for interfacing with a transmitter/receiver ("transceiver") 628, audio processing circuitry, such as an audio processor 613, and a position receiver 626, such as a global positioning system ("GPS") receiver. An antenna 611 may be coupled to transceiver 628 for bi-directional communication, such as cellular and/or satellite communication.

Mobile device 620 may include a media recorder and processor 627, such as a still camera, a video camera, an audio recorder, or the like, to capture digital pictures, audio and/or video. Microprocessor or microcontroller 625 may be interconnected for interfacing with media recorder and processor 627. Image, audio and/or video files corresponding to the pictures, songs and/or video may be stored in memory 630 as data 636.

Mobile device 620 may include an audio processor 613 for processing audio signals, such as for example audio information transmitted by and received from transceiver 628. Microprocessor or microcontroller 625 may be interconnected for interfacing with audio processor 613. Coupled to audio processor 613 may be one or more speakers 614 and one or more microphones 619, for projecting and receiving sound, including without limitation recording sound, via mobile device 620. Audio data may be passed to audio processor 613 for playback. Audio data may include, for example, audio data from an audio file stored in memory 630 as data 636 and retrieved by microprocessor or microcontroller 625. Audio processor 613 may include buffers, decoders, amplifiers and the like.

Mobile device 620 may include one or more local wireless interfaces 610, such as a Wi-Fi interface, an infrared transceiver, and/or an RF adapter. Wireless interface 610 may provide a Bluetooth adapter, a WLAN adapter, an Ultra-Wideband ("UWB") adapter, and/or the like. Wireless interface 610 may be interconnected to an antenna 612 for communication. As is known, a wireless interface 610 may be used with an accessory, such as for example a hands-free adapter and/or a headset. For example, audible output sound corresponding to audio data may be transferred from mobile device 620 to an adapter, another mobile radio terminal, a computer, or another electronic device. In another example, wireless interface 610 may be for communication within a cellular network or another Wireless Wide-Area Network (WWAN).

Figure 7:
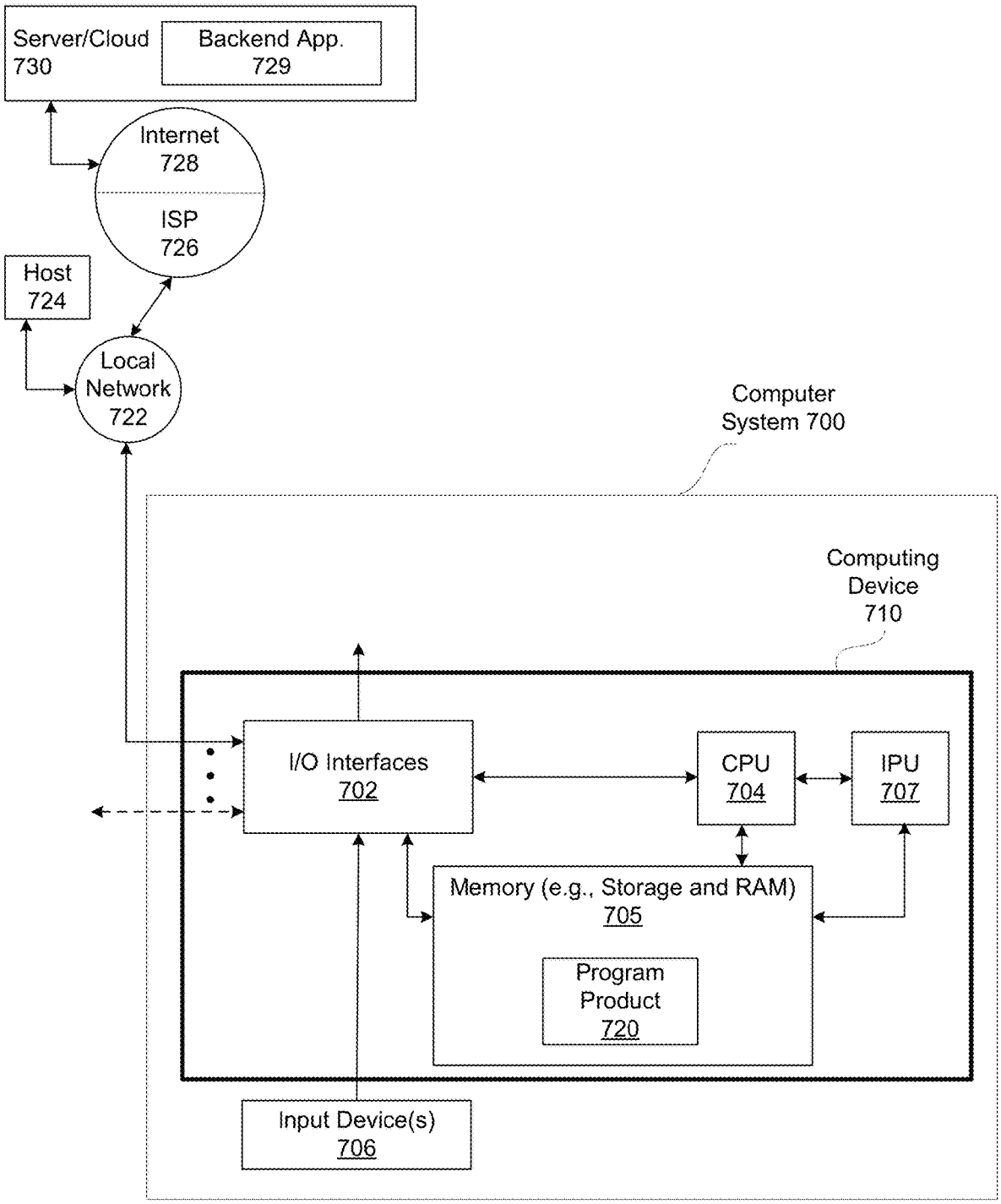
FIG. 7 is a block diagram depicting an example of a computer system.

FIG. 7 is a block diagram depicting an example of a computer system 700 upon which one or more aspects described herein may be implemented. Computer system 700 may include a programmed computing device 710 coupled to one or more input devices 706. Other known configurations of a computer system may be used. Computer system 700 by itself or networked with one or more other computer systems 700 may provide an information handling system.

Programmed computing device 710 may be programmed with a suitable operating system, which may include Mac OS, Java Virtual Machine, Real-Time OS Linux, Solaris, iOS, Darwin, Android Linux-based OS, Linux, OS-X, UNIX, or a Windows operating system, among other platforms, including without limitation an embedded operating system, such as VxWorks. Programmed computing device 710 includes a central processing unit ("CPU") 704, one or more memories and/or storage devices ("memory") 705, and one or more input/output ("I/O") interfaces ("I/O interface") 702. Programmed computing device 710 may optionally include a graphics or image processing unit ("IPU") 707 coupled to CPU 704 and one or more peripheral cards 709 coupled to I/O interface 702.

CPU 704 may be a type of microprocessor known in the art, such as available from IBM, Intel, ARM, and Advanced Micro Devices for example. CPU 704 may include one or more processing cores. Support circuits (not shown) may include busses, cache, power supplies, clock circuits, data registers, and the like.

Memory 705 may be directly coupled to CPU 704 or coupled through I/O interface 702. At least a portion of an operating system may be disposed in memory 705. Memory 705 may include one or more of the following: flash memory, random access memory, read only memory, magneto-resistive read/write memory, optical read/write memory, cache memory, magnetic read/write memory, and the like, as well as non-transitory signal-bearing media as described below. For example, memory 705 may include an SSD, which is coupled to I/O interface 702, such as through an NVMe-PCIe bus, SATA bus or other bus. Moreover, one or more SSDs may be used, such as for NVMe, RAID or other multiple drive storage for example.

I/O interface 702 may include chip set chips, graphics processors, and/or daughter cards, among other known circuits. In this example, I/O interface 702 may be a Platform Controller Hub ("PCH"). I/O interface 702 may be coupled to a conventional keyboard, network, mouse, camera, microphone, display printer, and interface circuitry adapted to receive and transmit data, such as data files and the like.

Programmed computing device 710 may optionally include one or more peripheral cards 709. An example of a daughter or peripheral card may include a network interface card ("NIC"), a display interface card, a modem card, and a Universal Serial Bus ("USB") interface card, among other known circuits. Optionally, one or more of these peripherals may be incorporated into a motherboard hosting CPU 704 and I/O interface 702. Along those lines, IPU 707 may be incorporated into CPU 704 and/or may be of a separate peripheral card.

Programmed computing device 710 may be coupled to a number of client computers, server computers, or any combination thereof via a conventional network infrastructure, such as a company's Intranet and/or the Internet, for example, allowing distributed use. Moreover, a storage device, such as an SSD for example, may be directly coupled to such a network as a network drive, without having to be directly internally or externally coupled to programmed computing device 710. However, for purposes of clarity and not limitation, it shall be assumed that an SSD is housed in programmed computing device 710.

Memory 705 may store all or portions of one or more programs or data, including variables or intermediate information during execution of instructions by CPU 704, to implement processes in accordance with one or more examples hereof to provide program product 720. Program product 720 may be for implementing portions of process flows, as described herein, including image processing for image recognition. Additionally, those skilled in the art will appreciate that one or more examples hereof may be implemented in hardware, software, or a combination of hardware and software. Such implementations may include a number of processors or processor cores independently executing various programs, dedicated hardware and/or programmable hardware.

Along those lines, implementations related to use of computing device 710 for implementing techniques described herein may be performed by computing device 710 in response to CPU 704 executing one or more sequences of one or more instructions contained in main memory of memory 705. Such instructions may be read into such main memory from another machine-readable medium, such as a storage device of memory 705. Execution of the sequences of instructions contained in main memory may cause CPU 704 to perform one or more process steps described herein. In alternative implementations, hardwired circuitry may be used in place of or in combination with software instructions for such implementations. Thus, the example implementations described herein should not be considered limited to any specific combination of hardware circuitry and software, unless expressly stated herein otherwise.

One or more program(s) of program product 720, as well as documents thereof, may define functions of examples hereof and can be contained on a variety of non-transitory tangible signal-bearing media, such as computer- or machine-readable media having code, which include, but are not limited to: (i) information permanently stored on non-writable storage media (e.g., read-only memory devices within a computer such as CD-ROM or DVD-ROM disks readable by a CD-ROM drive or a DVD drive); or (ii) alterable information stored on writable storage media (e.g., floppy disks within a diskette drive or flash drive or hard-disk drive or read/writable CD or read/writable DVD).

Computer readable storage media encoded with program code may be packaged with a compatible device or provided separately from other devices. In addition, program code may be encoded and transmitted via wired optical, and/or wireless networks conforming to a variety of protocols, including the Internet, thereby allowing distribution, e.g., via Internet download. In implementations, information downloaded from the Internet and other networks may be used to provide program product 720. Such transitory tangible signal-bearing media, when carrying computer-readable instructions that direct functions hereof, represent implementations hereof.

Along those lines the term "tangible machine-readable medium" or "tangible computer-readable storage" or the like refers to any tangible medium that participates in providing data that causes a machine to operate in a specific manner. In an example implemented using computer system 700, tangible machine-readable media are involved, for example, in providing instructions to CPU 704 for execution as part of programmed product 720. Thus, a programmed computing device 710 may include programmed product 720 embodied in a tangible machine-readable medium. Such a medium may take many forms, including those describe above.

The term "transmission media", which includes coaxial cables, conductive wire and fiber optics, including traces or wires of a bus, may be used in communication of signals, including a carrier wave or any other transmission medium from which a computer can read. Transmission media can also take the form of acoustic or light waves, such as those generated during radio-wave and infra-red data communications.

Various forms of tangible signal-bearing machine-readable media may be involved in carrying one or more sequences of one or more instructions to CPU 704 for execution. For example, instructions may initially be carried on a magnetic disk or other storage media of a remote computer. The remote computer can load the instructions into its dynamic memory and send such instructions over a transmission media using a modem. A modem local to computer system 700 can receive such instructions on such transmission media and use an infra-red transmitter to convert such instructions to an infra-red signal. An infra-red detector can receive such instructions carried in such infra-red signal and appropriate circuitry can place such instructions on a bus of computing device 710 for writing into main memory, from which CPU 704 can retrieve and execute such instructions. Instructions received by main memory may optionally be stored on a storage device either before or after execution by CPU 704.

Computer system 700 may include a communication interface as part of I/O interface 702 coupled to a bus of computing device 710. Such a communication interface may provide a two-way data communication coupling to a network link connected to a local network 722. For example, such a communication interface may be a local area network ("LAN") card to provide a data communication connection to a compatible LAN. Wireless links may also be implemented. In any such implementation, a communication interface sends and receives electrical, electromagnetic or optical signals that carry digital and/or analog data and instructions in streams representing various types of information.

A network link to local network 722 may provide data communication through one or more networks to other data devices. For example, a network link may provide a connection through local network 722 to a host computer 724 or to data equipment operated by an Internet Service Provider ("ISP") 726 or another Internet service provider. ISP 726 may in turn provide data communication services through a world-wide packet data communication network, the "Internet" 728. Local network 722 and the Internet 728 may both use electrical, electromagnetic or optical signals that carry analog and/or digital data streams. Data carrying signals through various networks, which carry data to and from computer system 700, are exemplary forms of carrier waves for transporting information.

Wireless circuitry of I/O interface 702 may be used to send and receive information over a wireless link or network to one or more other devices' conventional circuitry such as an antenna system, an RF transceiver, one or more amplifiers, a tuner, one or more oscillators, a digital signal processor, a CODEC chipset, memory, and the like. In some implementations, wireless circuitry may be capable of establishing and maintaining communications with other devices using one or more communication protocols, including time division multiple access (TDMA), code division multiple access (CDMA), global system for mobile communications (GSM), Enhanced Data GSM Environment (EDGE), wideband code division multiple access (W-CDMA), Long Term Evolution (LTE), LTE-Advanced, WIFI (such as IEEE 802.11a, IEEE 802.11b, IEEE 802.11g and/or IEEE 802.11n), Bluetooth, Wi-MAX, voice over Internet Protocol (VoIP), near field communication protocol (NFC), a protocol for email, instant messaging, and/or a short message service (SMS), or any other suitable communication protocol. A computing device can include wireless circuitry that can communicate over several different types of wireless networks depending on the range required for the communication. For example, a short-range wireless transceiver (e.g., Bluetooth), a medium-range wireless transceiver (e.g., Wi-Fi), and/or a long range wireless transceiver (e.g., GSM/GPRS, UMTS, CDMA2000, EV-DO, and LTE/LTE-Advanced) can be used depending on the type of communication or the range of the communication.

Computer system 700 can send messages and receive data, including program code, through network(s) via a network link and communication interface of I/O interface 702. In the Internet example, a server 730 might transmit a requested code for an application program through Internet 728, ISP 726, local network 722 and I/O interface 702. Server 730 may host a backend app 729, such as to provide a more powerful version of image processing and image recognition for reasons as described elsewhere herein. Received code may be executed by processor 704 as it is received, and/or stored in a storage device, or other non-volatile storage, of memory 705 for later execution. In this manner, computer system 700 may obtain application code in the form of a carrier wave.

While the foregoing describes exemplary apparatus(es) and/or method(s), other and further examples in accordance with the one or more aspects described herein may be devised without departing from the scope hereof, which is determined by the claims that follow and equivalents thereof. Claims listing steps do not imply any order of the steps. Trademarks are the property of their respective owners.

What is claimed is:

1. A system for printing, comprising:

a plurality of unmanned aerial vehicles (UAVs);

a guide rail attached to a first unmanned aerial vehicle (UAV) of the plurality of UAVs;

an insert or a carriage guide (guide) attached to a second UAV of the plurality of UAVs, wherein the guide is configured for coupling into or onto the guide rail for slidable movement;

a printhead assembly attached to the guide for movement therewith, wherein the printhead assembly includes at least one colorant material holder;

the first UAV is configured for controllable in-flight movement of the guide rail to a print target;

the second UAV is configured for controllable in-flight movement of the guide for engagement into or onto the guide rail for the slidable movement in or on the guide rail; and the second UAV is configured for communication with the printhead assembly for controlled printing including in part movement of the guide by the second UAV relative to the guide rail.

2. The system according to claim 1, wherein:

the first UAV is configured with a first computer vision subsystem;

the second UAV is configured with a second computer vision subsystem; and each of the first UAV and the second UAV is configured for image recognition for controlling the movement of the first UAV and the second UAV, respectively.

3. The system according to claim 1, further comprising a frame connected to the guide rail.

4. The system according to claim 3, wherein the frame comprises a plurality of attachment devices for removably attaching the frame to the print target or a rigid structure backing the print target.

5. The system according to claim 4, wherein the attachment devices are selected from a group including clamps, suction cups, or electro-magnets.

6. The system according to claim 1, wherein the guide rail includes at least one attachment device for removably attaching the guide rail to the print target or a rigid structure backing the print target.

7. The system according to claim 1, wherein the printhead assembly is an inkjet printhead assembly including at least one cartridge for the at least one colorant material holder.

8. A system for printing, comprising:

a plurality of unmanned aerial vehicles (UAVs);

a guide rail attached to a first unmanned aerial vehicle (UAV) of the plurality of UAVs;

an insert or a carriage guide (guide) attached to a second UAV of the plurality of the UAVs, wherein the guide is configured for coupling into or onto the guide rail for slidable movement;

a printhead assembly attached to a slidable portion of the guide for movement therewith, wherein the printhead assembly includes at least one colorant material holder;

the first UAV is configured for controllable in-flight movement of the guide rail to a print target;

the second UAV is configured for controllable in-flight movement of the guide for engagement into or onto the guide rail for the slidable movement in or on the guide rail; and the second UAV configured for communication with the printhead assembly for controlled printing including in part movement of the slidable portion of the guide.

9. The system according to claim 8, wherein:

the first UAV is with a first computer vision subsystem;

the second UAV is configured with a second computer vision subsystem; and each of the first UAV and the second UAV is configured for image recognition for controlling the movement of the first UAV and the second UAV, respectively.

10. The system according to claim 8, further comprising a frame connected to the guide rail.

11. The system according to claim 10, wherein the frame comprises a plurality of attachment devices for removably attaching the frame to the print target or a rigid structure backing the print target.

12. The system according to claim 11, wherein the attachment devices are selected from a group including clamps, suction cups, or electro-magnets.

13. The system according to claim 8, wherein the guide rail includes at least one attachment device for removably attaching the guide rail to the print target or a rigid structure backing the print target.

14. The system according to claim 8, wherein the printhead assembly is an inkjet printhead assembly including at least one cartridge for the at least one colorant material holder.

15. A method for printing, comprising:

obtaining a plurality of unmanned aerial vehicles (UAVs) having a first unmanned aerial vehicle (UAV) attached to a guide rail and a second UAV attached to an insert or a carriage guide (guide);

wherein the guide is configured for coupling into or onto the guide rail for slidable movement with a printhead assembly attached to the guide for movement therewith;

wherein the printhead assembly includes at least one colorant material holder;

controlling in-flight movement of the guide rail via the first UAV to a print target;

controlling in-flight movement of the second UAV for engagement of the guide into or onto the guide rail; and communicating by the second UAV to the printhead assembly for controlled printing responsive in part to movement of the guide by the second UAV relative to the guide rail.

16. The method according to claim 15, wherein:

the controlling of the in-flight movement of each of the first UAV and the second UAV is by a first computer vision subsystem and a second computer vision subsystem, respectively thereof; and the communicating for the controlled printing includes in part movement of the guide by the second UAV under control of the second computer vision subsystem.

17. The method according to claim 16, further comprising removably attaching a frame connected to the guide rail to the print target or a rigid structure backing the print target.

18. The method according to claim 17, wherein the frame comprises a plurality of attachment devices for the removably attaching of the frame to the print target or the rigid structure backing the print target.

19. The method according to claim 16, further comprising removably attaching the guide rail to the print target or a rigid structure backing the print target.

20. The method according to claim 19, wherein the guide rail includes at least one attachment device for the removably attaching of the guide rail to the print target or a rigid structure backing the print target.

* * * * *